United States Patent [19]

Tsukuda

[11] 4,179,123

[45] Dec. 18, 1979

[54] BASEBALL GAME BOARD

[76] Inventor: Mitsuo Tsukuda, No. 1-3, 3-chome, Moto-Asakusa, Taito-ku, Tokyo, Japan

[21] Appl. No.: 910,775

[22] Filed: May 30, 1978

[30] Foreign Application Priority Data

Sep. 16, 1977 [JP] Japan ..... 52-123540[U]
Sep. 16, 1977 [JP] Japan ..... 52-123541[U]

[51] Int. Cl.[2] ..... H63F 7/10

[52] U.S. Cl. ..... 273/89; 273/129 E; 273/129 HA; 124/56

[58] Field of Search ..... 273/88, 89, 90, 118 A, 273/129 E, 129 HA

[56] References Cited

U.S. PATENT DOCUMENTS

| | | | |
|---|---|---|---|
| 1,994,685 | 3/1935 | Callejas | 273/89 |
| 2,470,159 | 5/1949 | Geary | 273/88 |
| 2,775,457 | 12/1956 | Galbos | 273/89 |
| 3,237,941 | 3/1966 | Vincent | 273/118 A |
| 3,730,525 | 5/1973 | Maeda | 273/89 |
| 3,985,358 | 10/1976 | Hamano | 273/89 |

FOREIGN PATENT DOCUMENTS

| | | | |
|---|---|---|---|
| 804299 | 4/1951 | Fed. Rep. of Germany | 273/129 E |

*Primary Examiner*—Richard C. Pinkham
*Assistant Examiner*—Scott L. Brown
*Attorney, Agent, or Firm*—Jay M. Cantor

[57] ABSTRACT

An improved baseball game board is provided comprising a rack and pinion batting mechanism for performing left-handed or right-handed batting, a pitching mechanism for continuously feeding balls and a band-like rubber magnet plate with indications of HIT, 2BH and 3BH applied onto the outfield fence.

1 Claim, 6 Drawing Figures

BASEBALL GAME BOARD

BACKGROUND OF THE INVENTION

The present invention relates to a baseball game board.

Up to now, there are proposed various kinds of baseball game boards wherein a board resembling an actual baseball ground in shape is provided in which fielding bodies are located on the positions corresponding to a catcher and other infielders as well as outfielders, a pitching mechanism is installed on the positions corresponding to a pither and a batting mechanism is disposed on the position corresponding to a batter, said batting mechanism being designed to hit a ball fed from said pitching mechanism as soon as it reaches the home base, and a runner doll being made to advance to a base in response to a position which the batted ball reaches to score runs. However, such baseball game boards are less interesting since a ball is hitted merely as by a bat secured on the right batting box by a bat rotation mechanism. Further, a serious inconvenience is caused by taking a ball out of a hit zone groove provided in the outfield fence since the groove is designed to catch the ball for calling a hit. Further inconvenience is brought about by the fact that the opposite player should feed a ball to a pitching mechanism one by one.

SUMMARY OF THE INVENTION

The present invention overcomes such disadvantages and provides a baseball game board by which one can play an enjoyable baseball game.

A first object of the present invention is to provide a batting mechanism for performing left- or right-handed batting in the batter box as desired.

A second object is to provide a mechanism for holding and dealing with an easily batted ball rolling toward the outfield fence.

A third object is to provide a mechanism for continuously feeding balls from a pitching member.

Other object will be apparent from the following detailed description of one embodiment, reference being made to the accompanying drawings.

DESCRIPTION OF THE PREFERRED EMBODIMENTS

Figure 1:
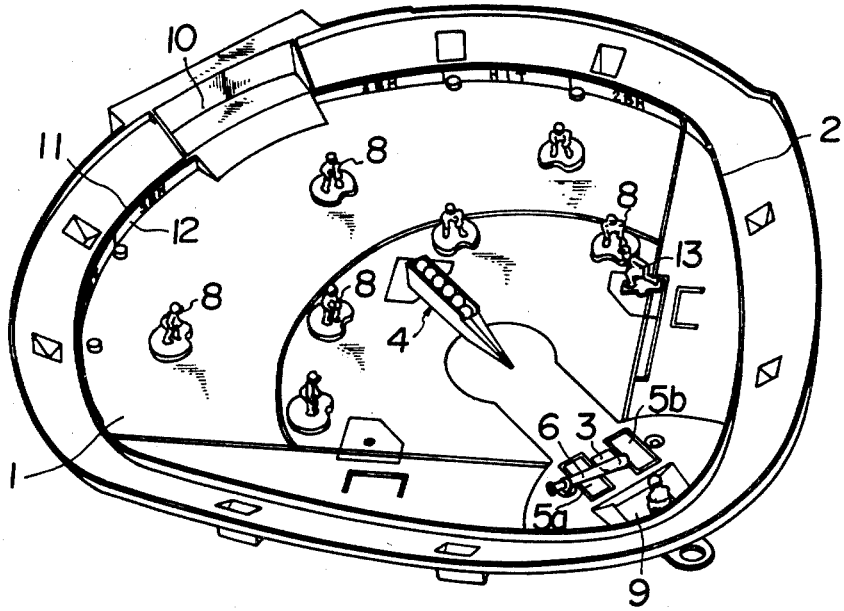
FIG. 1 is a perspective view showing the baseball game board according to the present invention.
Figure 2:
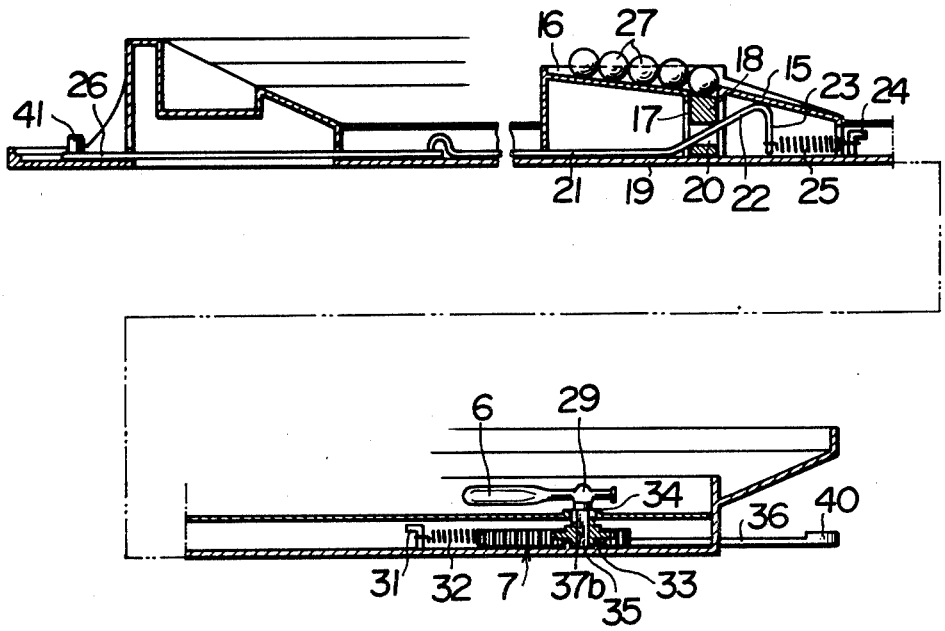
FIG. 2 is a longitudinally sectional view of FIG. 1.
Figure 3:
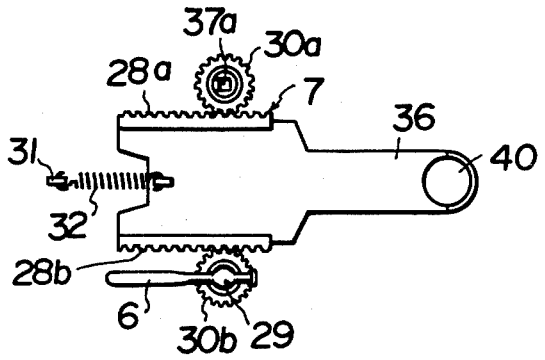
FIG. 3 is a plan view showing the batting mechanism according to the present invention.
Figure 4:
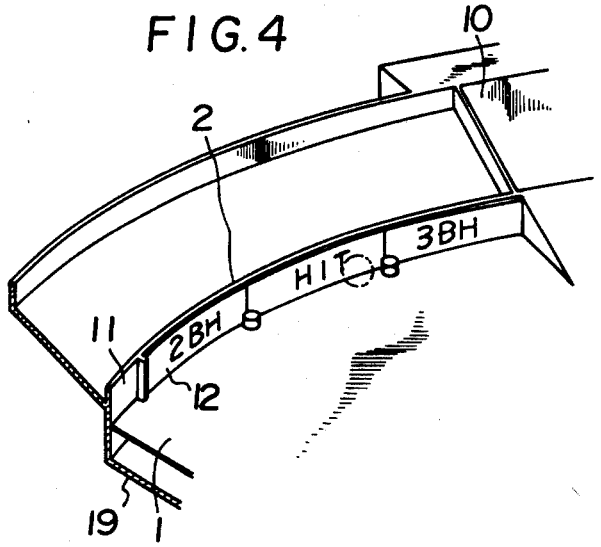
FIG. 4 is a partially perspective view showing the outfield fence according to the present invention.
Figure 5:
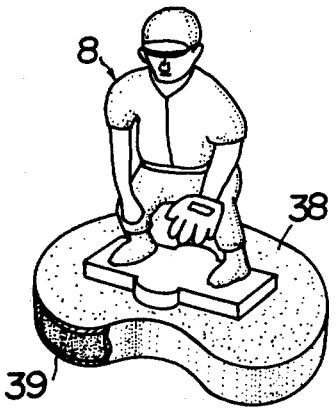
FIG. 5 is a partially cut away, perspective view showing a part of an infielder and outfielder.
Figure 6:
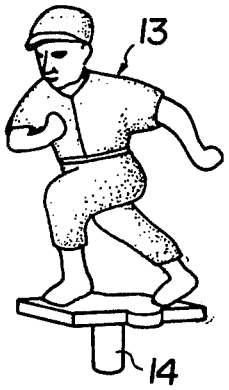
FIG. 6 is a perspective view showing a runner.

Referring now to FIG. 1, the lines for defining a baseball ground are drawn on the surface of a board 1 formed of a magnetic plate such as an iron plate, and a wall member 2 is provided around the board, whereby a baseball game board is formed.

The wall member 2 also defines the outfield stand and infield stand as well as the infield fence and outfield fence.

A pitching mechanism generally indicated by 4 directing toward the home base 3 is mounted virtually on the center of the board 1.

A batting mechanism 7 having a bat secured rotatingly thereto is mounted on the both sides of the home base 3.

Fielding dolls each having an appropriate catching function are arranged on the fielding positions being in the infield and outfield, and a ball storage means 9 is provided in front of the home base 3. A home run zone 10 is also provided in the outfield stand defined by the wall member 2. Further, a band-like rubber magnet plate 12 with indications of HIT, 2BH and 3BH on its surface, which attracts a metallic ball, is adhered to the front surface of the outfield fence 11. As evident from this figure, the first, second and third bases on the board each are designed to have a small hole therein, so that a runner doll 13 is supported by a shaft 14 underneath it.

The pitching mechanism 4 comprises an inclined groove 15 which slants downwardly with respect to the home base 3 and the point of which gives forth light and means 16 for receiving a plurality of balls which inclines gently upwardly from the rear portion of the inclined groove 15, the bottom of means 16 being disposed at a position lower than that of the inclined groove 15 by one step. A groove 17 is provided between the groove 15 and the means 16 and is provided with a rod 18 having the same inclined plane as that of the bottom of the inclined groove 15 such that the inclined surface is supported on a bottom plate 19 through the board 1 at a position lower than the bottom of the ballstorage means 16 by one step. A pitching lever 21 one end of which protrudes outwardly from the outfield fence is inserted with its upwardly inclined portion 22 into a through hole 20. The bent portion of the lever is connected by way of a coil spring 25 to a shaft 24 provided vertically in the bottom plate 19. The pitching lever 21 is permitted to go up and down through traction and release of its projection portion 26 protruding from the outfield fence, so that a ball on the rod 19 of plural balls 27 accomodated in the ball storage means 16 rises and is fed into the inclined groove 15, which ball is then allowed to roll down toward the home base 3.

The batting mechanism 7 comprises a batting lever 36 having racks **28*a*, 28*b* on both sides of its front portion and pinions 30*a*, 30*b* engaging the racks 28*a*, 28*b*. This batting mechanism has its front end connected by way of a coil spring 32 to a shaft 31 vertically provided in the bottom plate 19 and its rear end protruding from the peripheral wall of the baseball game board, i.e. the wall member 2. A shaft 15 is supported on bearings 33 vertically provided in the bottom plate 19 and bearing holes 34 bored in the surface of the board 1, such that the pinions 30*a*, 30*b* are rotated by traction or release of the batting lever 36. Mounting holes 37*a*, 37*b* are formed on the central portions of the pinions 30*a*, 30*b* for the purpose of securing detachably the support rod 35 of the bat 6 thereto. The bat 6** is secured to either one of the holes.

The fielding dolls 8 each are vertically provided on the upper surface of a magnetic seat member 38 having an opening on its under-surface. This doll having a permanent magnet inside is secured to the board by attraction, and is designed to catch a magnetic ball 27 rolling toward its vicinity by attraction.

In order to play a game using the embodiment constructed as above, the fielders, i.e. the fielding dolls are placed on the fielding positions, and a given number of balls 27 (six balls in this case) are charged in the ball storage means 16. Next, the batting side assumes a batting posture of bat 6 by pulling a finger portion 40 formed at the end of the lever 36 of the batting mechanism 7, while the fielding side assumes a pitching posture by pulling a finger portion 41 formed at the end of the lever 21 of the pitching mechanism 21. At the signal of commence of a game, the field side tracts and releases the lever 21, so that the rod 18 goes up and until its inclined upper surface coincides with the sloping surface of the inclined groove 15, and then goes down. Thus, when the rod 18 assumes the highest position, the ball 27 rolls down into the inclined groove and slides on the board toward the home base 3. The batting side gives a timely blow to the ball 27 reaching the home base through traction and release of the lever 36, i.e. by swinging the bat 6 on the home base through rotation of the pinion **30*b* on the state as shown in the drawings. When the thus batted ball is on the foul territory, a foul is called. When the ball rolls on the fair territory and is attracted to any one of the fielding dolls 8, an out is called. When the ball is attracted to a portion of the rubber magnet plate 12 applied onto the wall member of the outfield fence 11 and the portion is indicated by HIT, a runner doll 13 is permitted to advance to the first base by supporting its shaft 14 in the hole thereof. When the next ball is attracted to a portion with indication of 2BH, the runner doll 13** is further sent to the home base so that the first point is scored. When the ball rolls down into the home run zone, the first point is scored as a home run. Playing a game using this game board, the balls and strikes judgement is made on the basis of mutual agreement of the players according to the existing baseball rule. A single hit and a long hit are called according to the indications on the attracting plate on the outfield fence. When the ball comes to a halt within the fair territory, a single hit is called. When a hit is called, a runner doll is made to advance to the corresponding base by inserting it into the hole of the base. A home run is called when the ball goes over the outfield fence or rolls down into the home run zone. An out is called when the batting side is struck out or the ball is caught. Although a scoreboard is not shown in the drawing, the runs may be recorded on a scorepad with a pencil etc.

The baseball game board according to the present invention makes it possible to play a speedy game since the pitching mechanism is of a simple and continuous pitching system. Furhter, since the fielding dolls are of a magnet-catching system, one can play an enjoyable game as in an actual baseball ground. Namely, it is possible to shift the fielding dolls as desired. Still further, the batting mechanism of a simple construction renders it possible to perform left-handed or right-handed batting as desired. The rebound of a ball is avoided by permitting the ball to be attracted to the band-like rubber magnet plate 12 with indications of HIT, 2BH and 3BH applied onto the front surface of the outfield fence, with the result that the kind of a hit is called positively. Thus, one can play an enjoyable game as in an actual baseball ground.

It is to be understood that the form of the invention herewith shown and described is to be taken as a presently preferred embodiment. Equivalent modifications and changes may be made for those skilled in the art, all without departing from the spirit or scope of the invention defined in the subjoined claims.

What is claimed is:

1. In a baseball game board wherein a board resembling an actual baseball ground in shape is provided in which fielding bodies are located at the positions corresponding to a catcher and other infielders as well as outfielders, a pitching mechanism is installed at the position corresponding to a pitcher and a batting mechanism is disposed at the position corresponding to a batter, said batting mechanism being designed to hit a ball fed rollingly from said pitching mechanism as soon as it reaches the home base and a runner doll which is advanced to a base in response to a position which the batted ball reaches to score runs, the improvements comprising a batting mechanism consisting of a batting lever having racks on both sides of its front portion and pinions engaging said racks and said batting lever having an end protruding from the peripheral wall of the baseball game board to the rear side of the home base and the front end being connected by way of a coil spring to a shaft vertically provided in a bottom plate, both pinions being disposed by supporting a shaft for both pinions in a shaft hole of the board, and said both pinions being provided on its shaft with mounting holes for securing a bat support rod such that a bat is detachably secured to either one of said mounting holes, a pitching mechanism comprising an inclined groove which slants downwardly with respect to the home base and a means for receiving a plurality of balls which is provided on said inclined groove at a gentle gradient, the bottom of said means being arranged at a position lower than that of said inclined groove by one step and a groove being provided therebetween; a rod having the same inclined surface as in the bottom of said inclined groove and having a through hole in its side in the horizontal direction which rod is slidingly supported on the bottom plate such that its inclined surface is arranged at a position lower than the bottom of said means by one step so as to receive the forefront ball of the balls fed into said means and thereby prevent it from rolling down into said inclined groove and a pitching lever protruding outwardly from the outfield fence, the upwardly inclined portion of the front end of said pitching lever being inserted into said through hole and being connected by way of a coil spring to a shaft having an end vertically provided in the bottom plate whereby the rod is permitted to go up through traction of said pitching lever so as to feed a ball on said rod into said inclined groove so that the ball rolls down toward the home base, and a band-like rubber magnet plate with indications of HIT, 2BH and 3BH applied onto the front surface of the outfield fence, which holds a magnetic ball reaching the outfield fence by attraction.

* * * * *